US005241837A

United States Patent [19]

Albertson, III

[11] Patent Number: 5,241,837

[45] Date of Patent: Sep. 7, 1993

[54] DOUBLE PASS PURGE SYSTEM

[75] Inventor: Luther D. Albertson, III, New Albany, Ind.

[73] Assignee: Redi Controls, Inc., Greenwood, Ind.

[21] Appl. No.: 794,460

[22] Filed: Nov. 19, 1991

[51] Int. Cl.[5] ..... F25B 43/04

[52] U.S. Cl. ..... 62/475; 62/85; 62/195

[58] Field of Search ..... 62/85, 195, 149, 292, 62/474, 475

[56] References Cited

U.S. PATENT DOCUMENTS

| | | | |
|---|---|---|---|
| 2,175,419 | 10/1939 | Whitney . | |
| 2,202,010 | 5/1940 | Kondolf . | |
| 3,131,548 | 5/1964 | Chubb et al. . | |
| 3,138,005 | 6/1964 | Bourne et al. . | |
| 3,145,544 | 8/1964 | Weller | 62/475 |
| 3,230,729 | 1/1966 | Eber . | |
| 3,276,216 | 10/1966 | Papapanu . | |
| 3,410,106 | 11/1968 | Brockie . | |
| 3,620,038 | 11/1971 | Muench . | |
| 4,169,356 | 10/1979 | Kingham . | |
| 4,267,705 | 5/1981 | Leonard et al. . | |
| 4,304,102 | 12/1981 | Gray | 62/195 |
| 4,316,364 | 2/1982 | Spauschus . | |
| 4,417,451 | 11/1983 | Spauschus . | |
| 4,646,527 | 3/1987 | Taylor . | |
| 4,984,431 | 1/1991 | Mount et al. . | |

*Primary Examiner*—John M. Sollecito

*Attorney, Agent, or Firm*—Woodard, Emhardt, Naughton Moriarty & McNett

[57] ABSTRACT

An auxiliary purge unit to be retrofitted to the existing purge unit of a low pressure refrigeration system includes a double-walled condenser portion, a pneumatic pressure chamber and a discharged-refrigerant tank. The double-walled condenser portion includes inner and outer walls with a chilled condensing coil disposed between the two walls, a stand pipe to create a reservoir of condensed refrigerant between the stand pipe and the inner wall, and an exhaust port for exhausting non-condensibles from the system. The pneumatic pressure chamber pressurizes the gas to be purged from the refrigeration system and delivers it to the chilled condensing coil. The discharged-refrigerant tank includes a float valve to prevent fluids from exiting the tank unless the valve is in the open position, and allows the elevated pressure of the system to be maintained. In operation, the gas to be purged from the system is pressurized, directed through the chilled condensing coil, and bubbled through the reservoir of liquid refrigerant.

1 Claim, 2 Drawing Sheets

DOUBLE PASS PURGE SYSTEM

FIELD OF THE INVENTION

The present invention relates generally to low pressure centrifugal chiller purge systems, and more particularly to an upgrade retrofit to existing centrifugal chiller low pressure refrigerant purge systems.

BACKGROUND TO THE INVENTION

Centrifugal chillers utilizing low pressure refrigerants operate at less than atmospheric pressure. When the unit is running, air and moisture may leak into the machine through low pressure areas, and may accumulate in the condenser during machine operation. The air in the condenser increases condensing pressure, increases compressor power requirements, and reduces the chiller's efficiency and cooling capacity.

A purge system is provided on all low pressure refrigerant centrifugal units to remove moisture and other non-condensibles that may leak into the machine. Known purge systems typically include a condenser to recapture refrigerant before it is exhausted into the atmosphere. The effectiveness of standard purge systems is limited, however, and even when operating properly purge units discharge substantial amounts of refrigerant into the atmosphere. Losses can be as much as eight pounds of refrigerant for every pound of air purged from the chiller.

The loss of refrigerant during the purge cycle is particularly disturbing in view of the fact that low pressure refrigerants typically include chlorofluorocarbons (CFC's) which are known to be especially hazardous. Further, due to the increased environmental risk posed by low pressure refrigerants, the cost of those refrigerants has increased significantly in the past several years.

The cost of replacing the entire purge system of an existing low pressure centrifugal chiller can be tens of thousands of dollars. In many cases, the cost of replacing the entire purge system of an existing low pressure centrifugal chiller is not justified considering the economics of the firm in which the chiller is used. However, an auxiliary purge system which can be retrofitted to the existing purge system may be economically feasible if it utilizes the components of an existing purge system to provide the first level of refrigerant recovery and dehydration. The auxiliary purge unit can then complete the refrigerant recovery process, providing a significant reduction in the release of environmentally hazardous compounds at an acceptably low cost.

A need therefore exists for an auxiliary purge unit which provides superior refrigerant recovery efficiency, and which can be retrofitted to the existing purge unit of a low pressure chiller to significantly reduce hazardous emissions at minimal cost. The present invention addresses that need.

SUMMARY OF THE INVENTION

An auxiliary purge unit to be retrofitted to the existing purge unit of a low pressure centrifugal chiller, includes, in one preferred embodiment, a double-walled condenser portion, a pneumatic pressure chamber and a discharged-refrigerant tank. The double-walled condenser portion includes: (a) a chilled condensing coil disposed between the two walls, (b) a stand pipe vertically disposed within the inner wall to create a reservoir of condensed refrigerant between the stand pipe and the inner wall, and (c) an exhaust port for exhausting non-condensibles from the system. The pneumatic pressure chamber includes (a) a flexible diaphragm disposed between the upper and lower pressure chamber walls and secured to the walls so as to prevent air from passing from the region of the chamber above the diaphragm to the region of the chamber below the diaphragm, (b) means for introducing pressurized air into the pneumatic pressure chamber above the flexible diaphragm, (c) a switch to initiate the pressurization of the pneumatic pressure chamber when appropriate for the efficient operation of the unit, and (d) a "T"-shaped tube for directing gas from the existing purge unit to the pneumaticlpressure chamber and from the pneumatic pressure chamber to the condensing coil. The discharged-refrigerant tank is connected to the stand pipe and includes a float valve to prevent fluids from exiting the tank unless the float valve is in the open position.

In operation, a gas to be purged from a refrigeration system fills the pneumatic pressure chamber and forces the flexible diaphragm to engage the initiate switch. Thereafter, pneumatic pressure forces the diaphragm to pressurize the gas to be purged, and directs the pressurized gas to the chilled condenser coil. The pressurized gas passes through the condensing coil where gaseous refrigerants are condensed back to the liquid phase. Non-condensed gases are then bubbled through a reservoir of liquid refrigerant to achieve further recovery of liquid refrigerant.

The present invention therefore provides a refrigerant recovery system which directs pressurized gas through both a chilled condensing coil and a reservoir of liquid refrigerant.

One object of the present invention is to provide a refrigeration purge unit which provides improved refrigerant recovery efficiency when compared to existing units.

Another object of the present invention is to provide an auxiliary purge unit which can be retrofitted to the existing purge unit of a low pressure chiller to increase refrigerant recovery efficiency for a minimal cost.

Further objects and advantages of the present invention will be apparent from the following drawing and description.

DESCRIPTION OF THE PREFERRED EMBODIMENTS

Figure 1:
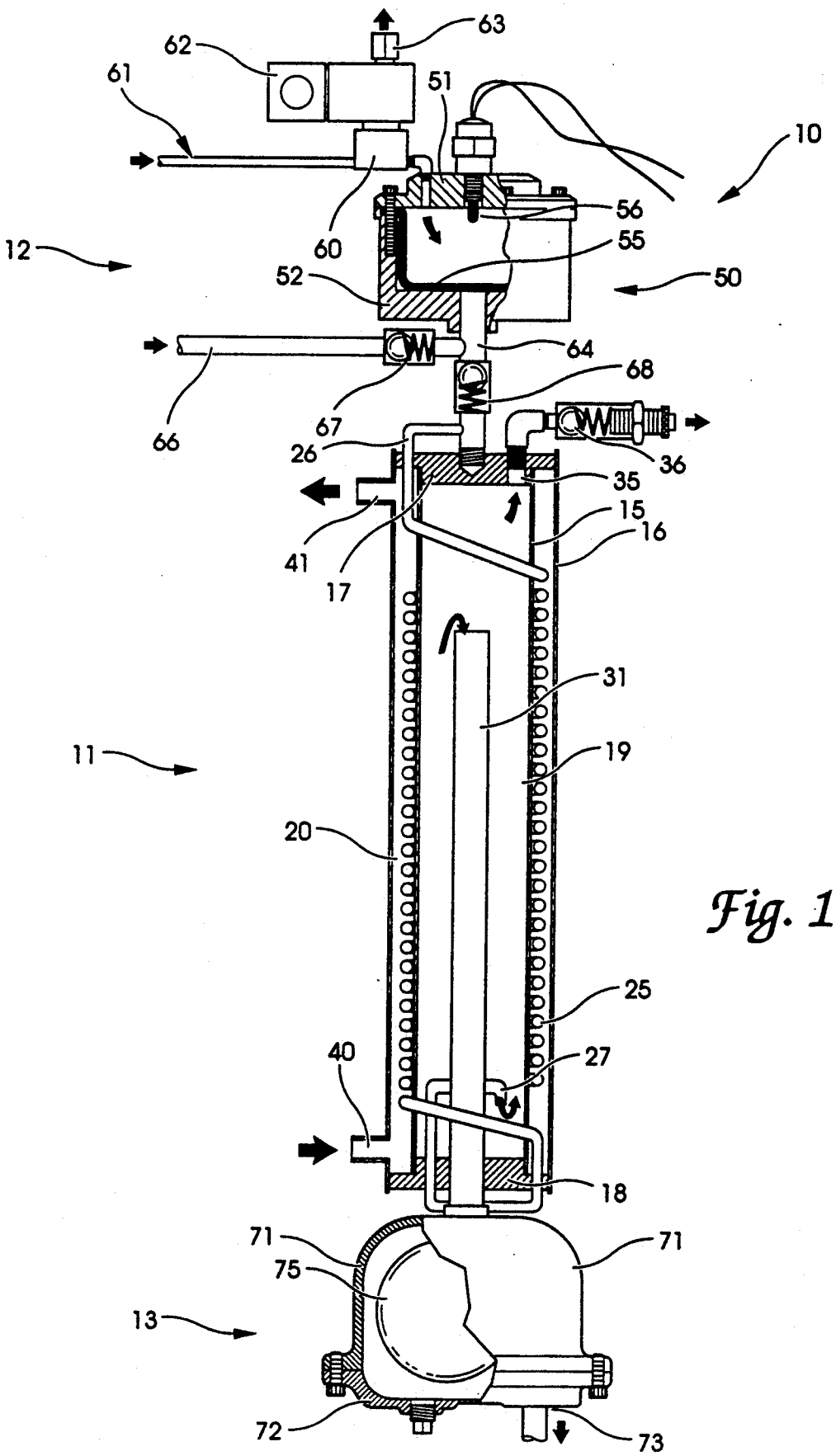
FIG. 1 is an elevational view, in partial section, of an auxiliary purge unit for a low pressure centrifugal chiller according to the preferred embodiment of the present invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention relates.

Referring now to the drawing, FIG. 1 shows the preferred embodiment of the auxiliary purge unit for a low pressure centrifugal chiller. Auxiliary purge unit 10 includes a double-walled condenser portion 11, a means 12 for providing pneumatic pressure to the condenser portion, and a discharged-refrigerant tank 13. The double-walled condenser portion 11 includes an inner wall 15, an outer wall 16, an upper end wall 17, and a lower end wall 18. The inner and outer walls define an interior chamber 19 within the inner wall 15, and an annular space 20 between the inner 15 and outer 16 walls.

A condensing coil 25 is disposed between the inner 15 and outer 16 walls, such that the upper end 26 of the condensing coil 25 extends through upper end wall 17, and the lower end 27 of the condensing coil 25 empties into the interior chamber 19 somewhat above lower end wall 18.

A stand pipe 30 is vertically disposed within interior chamber 19 such that the upper end 31 of the stand pipe 30 is located in the upper region of the chamber, while the lower end 32 of the stand pipe 30 extends through lower end wall 18.

An opening 35 in upper end wall 17 allows for the exhaust of non-condensibles from interior chamber 19 when a sufficient pressure has been achieved. An exhaust valve 36 is preferably installed in the opening to control the pressure at which gas is purged from the system, and accordingly, the pressure at which the system normally operates.

Coolant inlet 40 and outlet 41 are provided to allow a fluid coolant to flow through the annular space 20 between the inner and outer walls. The flow of liquid coolant is effective to reduce the temperature in and around the condensing coil 25 so that refrigerant condensation will occur.

Means 12 for providing pneumatic pressure to condenser portion 11 consists essentially of a pneumatic pressure chamber 50 having at least an upper wall 51 and a lower wall 52. A flexible diaphragm 55 is secured to the walls of the pneumatic pressure chamber so as to prevent air from passing from the region of the chamber above the diaphragm to the region of the chamber below the diaphragm. A switch 56 to initiate the pressurization of the chamber is provided in upper wall 51.

Means 60 for introducing pressurized-air into the pneumatic pressure chamber above flexible diaphragm 55 is also provided. In the preferred embodiment, pressurized-air means 60 includes a pneumatic pressure line 61 and a three-way air solenoid valve 62. The solenoid valve includes an exhaust 63.

Also included in pneumatic pressure means 12, is means 64 for directing gas from the existing purge unit of the low pressure chiller to the region of the pneumatic pressure chamber below the diaphragm, and from the region of the pneumatic pressure chamber below the diaphragm to the first end of the condensing coil. In the preferred embodiment, gas directing means 64 is a three-ended (e.g., T-shaped or Y-shaped) tube with one end connected to the exhaust line 66 of the original purge unit of the low pressure chiller, another end connected to the lower region of the pneumatic pressure chamber below the diaphragm, and the third being connected to the condenser coil. One-way gas valves 67 and 68 are preferably included in gas directing means 64 to prevent gas from flowing "backwards" into the chiller or pneumatic pressure chamber respectively.

Discharged-refrigerant tank 13 is comprised of a main tank portion having at least upper 71 and lower 72 walls, an opening 73 in the lower wall 72 of the tank to allow recaptured refrigerant to leave the auxiliary purge unit and be returned to the chiller, a float valve 75 in the tank to prevent fluids from entering the opening in the lower wall of the tank unless the float valve is in the open position, and an opening 76 in at least one wall of the tank to allow fluids to pass from the stand pipe to the discharged-refrigerant tank.

In normal operation, gas enters the auxiliary purge unit through gas inlet tube 66 after leaving the original purge unit of a low pressure centrifugal chiller. After passing through valve 67, the gas is directed through gas directing means 64 to the lower portion of pneumatic pressure chamber 50. As pneumatic pressure chamber 50 fills with gas, flexible diaphragm 55 is forced upward toward the upper wall of the chamber. When the flexible diaphragm becomes pressed against the upper wall 51 of the chamber, switch 56 is engaged and chamber pressurization is initiated. The chamber becomes pressurized as air passes through the three-way solenoid valve 62 and enters chamber 50 above the flexible diaphragm. As chamber 50 becomes pressurized, flexible diaphragm 55 is forced down toward the bottom wall 52 of the chamber and the gas is forced through gas directing means 64 to the upper end 26 of condenser coil 25. Once the gas enters the condenser coil it is prevented by flow control valve 68 from returning to the pneumatic pressure chamber.

The pressure differential between pneumatic pressure chamber 50 and interior chamber 19 forces the gas to pass through the entire length of condenser coil 25 and to exit the coil at lower end 27. As the gas passes through the condenser coil it cools due to the thermal transfer between the gas in the coil and the coolant in the annular space 20 surrounding the coil. Accordingly, the gaseous refrigerant condenses to a liquid as it passes through the coil. Liquid refrigerant and non-condensibles (e.g., air) are subsequently discharged from the lower end 27 of the condenser coil.

As the condensed refrigerant is discharged into the lower portion of interior chamber 19, the condensate fills the chamber until it enters the top 31 of stand pipe 30. Non-condensibles are released through opening 35, and are purged from the system. Condensate flows through the stand pipe and into the discharged-refrigerant tank 13. As the liquid level in tank 13 rises, float valve 75 opens, allowing condensed refrigerant to leave tank 13 and flow back to the chiller.

It is to be appreciated that the present invention provides a "double pass" purge system wherein the gas which has been purged from the original purge unit must not only pass through a secondary condensing coil, but must also pass through a column of condensed refrigerant before being purged from the system. Therefore, during this second pass, molecular attraction acts to "pull" additional refrigerant from the gas phase to the liquid phase where it can be returned to the chiller. This double pass system is believed to be unique in the art and provides increased refrigerant recovery efficiency.

It is also to be appreciated that the system operates under increased pressure in normal operation, according to the settings of pneumatic pressure means 60 and exhaust valve 36. This increased pressure is preferably between 70 psi and 100 psi, is an important aspect of the present invention, and is directly related to the increased efficiency of this refrigerant recovery system. Further, the system remains pressurized even after a purge cycle is complete, providing a more energy efficient device which need not be repressurized from a relatively low pressure during every cycle. The system can remain pressurized due to fact that the non-condensible exhaust valve is located at the end of the line, after the gas has made its final pass through the condenser chamber.

Finally, it is to be appreciated that the present invention utilizes standard pneumatic pressure to pressurize the system, keeping both fixed and operating costs low.

Figure 2:
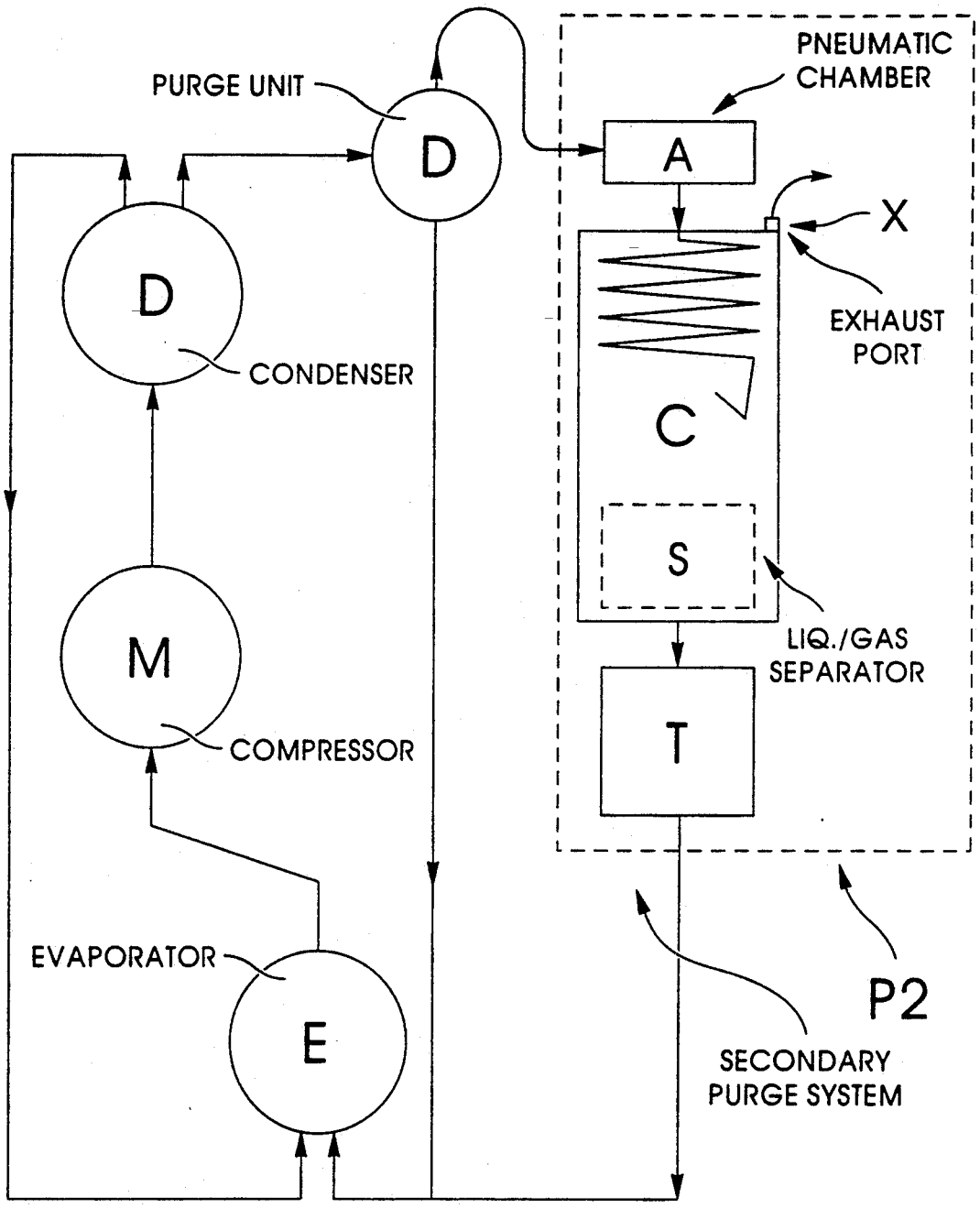
FIG. 2 is a schematic drawing of the retrofitted purge system in cooperation with the components of the existing refrigeration system.

FIG. 2 shows how the double pass purge system of the present invention operates in cooperation with the original purge system of a refrigeration system. The gas to be purged from the refrigeration system is exhausted from the existing (first) purge unit P1 and is directed to the pneumatic pressure chamber A of the present invention. The pneumatic pressure chamber acts to compress the gas so that pressurized gas is provided to the secondary purge system. After being compressed, the gas leaves pneumatic pressure chamber A and is directed to the condenser portion C of the present invention. The pressurized fluids pass through the chilled condensing coil and are discharged into the interior of the condenser portion. The interior of the condenser portion acts as a liquid/gas separator so that non-condensibles are exhausted from exhaust port X, while recovered liquid refrigerant is directed to tank T. The recovered refrigerant, along with refrigerant recovered in the main original purge unit, is thereafter directed to the main evaporator E. Main compressor M and main condenser D of the refrigeration system complete the loop back to first purge unit P1. It can therefore be seen that the present invention provides a refrigeration system with a secondary purge system P2 having a secondary compressor A, a secondary condenser C and a liquid/-gas separator S to cooperate with the main compressor and main condenser of the refrigeration system.

Clearly, a large number of cosmetic changes may be made to adapt the retrofit purge system to a particular centrifugal chiller without changing the fundamental features of the design. Therefore, while the invention has been illustrated and described in detail in the foregoing drawing and description, the same are to be considered illustrative and not restrictive in character, it being understood that the preferred embodiment has been shown and described, and that all changes and modifications that come within the spirit of the invention are desired to be protected.

I claim:

1. A low pressure refrigeration system with an improved two stage purge of gasses comprising:

(a) main compressor for compressing refrigerant;

(b) a main condenser with an input connected to the output of said main compressor and having a condensed refrigerant output and a purge gas output;

(c) an evaporator having an input connected to the condensed refrigerant output of said main condenser, and having an output connected to the input of said main compressor;

(d) a first purge system having an input connected to said purge gas output of said main condenser, and having a condensed refrigerant return output connected to an input of said evaporator, and having a purge gas output;

(e) a second purge system having:

(1) a secondary compressor having its input connected to said purge gas output of said first purge system;

(2) a secondary condenser having its input connected to the output of said secondary compressor and having an output side;

(3) a liquid/gas separator positioned downstream from said secondary condenser for separating condensed refrigerant from uncondensed gasses; and (4) a pressure relief valve connected to said separator for venting uncondensed gasses.

* * * * *